United States Patent [19]

Larson et al.

[11] 3,996,491

[45] Dec. 7, 1976

[54] EXTERNAL CONNECTIVE MEANS FOR A CATHODE RAY TUBE

[75] Inventors: J. Frederick Larson, Seneca Falls; Harry R. Swank, Waterloo, both of N.Y.

[73] Assignee: GTE Sylvania Incorporated, Stamford, Conn.

[22] Filed: Feb. 20, 1976

[21] Appl. No.: 659,782

Related U.S. Application Data

[63] Continuation of Ser. No. 500,500, Aug. 26, 1974, abandoned.

[52] U.S. Cl. ..... 313/479; 178/7.8

[51] Int. Cl.[2] ..... H01J 29/00; H01J 31/00

[58] Field of Search ..... 315/8; 178/7.8

[56] References Cited

UNITED STATES PATENTS

| | | | |
|---|---|---|---|
| 2,851,679 | 9/1958 | Wayne | 178/7.8 |
| 3,240,985 | 3/1966 | Ammerman et al. | 313/479 X |
| 3,340,420 | 9/1967 | Compton et al. | 313/450 X |
| 3,443,138 | 5/1969 | Schwartz | 315/8 |
| 3,564,329 | 2/1971 | Uetz | 315/8 |
| 3,746,904 | 7/1973 | Torre | 313/479 |

*Primary Examiner*—Robert Segal
*Attorney, Agent, or Firm*—Norman J. O'Malley; Frederick H. Rinn; Robert T. Orner

[57] ABSTRACT

A connective improvement disposed on the exterior of a cathode ray tube includes the metallic fracture-protective member peripherally surrounding the panel as an integral part of the circuitry connecting the exterior coating on the funnel portion of the tube envelope with appropriate grounding circuitry in the chassis. A discrete deposition of connective conductive material is applied to the exterior of the funnel and panel areas, whereof the funnel disposed section has the exterior funnel coating overlaid thereon. The opposed panel-disposed section makes positive connection with the peripheral protective member, which in turn, has a connective element associated therewith to complete the grounding circuitry without disturbing the intervening conductive material or the funnel coating associated therewith.

2 Claims, 5 Drawing Figures

EXTERNAL CONNECTIVE MEANS FOR A CATHODE RAY TUBE

CROSS REFERENCE TO RELATED APPLICATION

This application is a continuation application of the parent application Ser. No. 500,500, filed Aug. 26, 1974, now abandoned, and incorporates by reference the disclosure set forth in that application which is assigned to the assignee of the present application.

BACKGROUND OF THE INVENTION

This invention relates to electrical connective means for a cathode ray tube and more particularly, to an improvement in the means for effecting an external electrical connection with the conductive coating disposed on the exterior surface of the funnel portion of the tube.

It is a conventional construction practice for cathode ray tubes employed in television and like applications, to have an electrical conductive coating, usually carbonaceous in nature, deposited on the interior surface of the funnel portion of the glass envelope. This coating, which covers a major portion of the funnel area, is normally of the same electrical potential as the final electrode of the electron gun assembly. Disposed upon the exterior surface of the funnel portion of the tube envelope, and covering a large area thereof, is another electrical conductive coating which is also usually composed of a carbonaceous material. This outer coating is conventionally connected to ground, since it is substantially superjacently related to the interiorly disposed coating, with the glass wall of the envelope therebetween, a capacitive effect is formed which is commonly utilized in the operational circuitry for filtering purposes. Thus, it is important that an adequate ground connection be made and maintained with the exterior coating on the envelope. An accepted practice to ground this outer coating, as employed in television and allied display equipment, has been to use a spring-like or resilient means oriented in a manner to press or exert contact pressure against the external coating; the spring member in turn being connected to ground circuitry in the chassis. Some adaptations of this type of contact means employ expensive and intricate harness arrangements. A disadvantage of the resilient contactor is evidenced in the spring becoming loose and thereby losing constant contact with the tube. A further disadvantage has been noted in the use of such resilient contact means wherein, through shipment and environmental vibration, the spring arrangement tends to shift causing an abrasion or rub-off of particles of the external coating thereby resulting in a poor or inadequate connection.

Another priorly utilized means for making ground contact with the outer coating of the tube, has been the use of a strip of conductive material, one end of which was bonded to the envelope in a manner to make contact with the exterior coating and whereof the free end of the strip formed a tab for connection with the ground circuitry. A disadvantage of this flexible connective means was evidenced in the loosening of the strip and an area of the associated coating upon flexure of the connector.

OBJECTS AND SUMMARY OF THE INVENTION

It is an object of the invention to reduce and obviate the aforementioned disadvantages evidenced in the prior art. Another object of the invention is to provide an improved and expeditious means for effecting a ground connection for the external coating on a cathode ray tube whereby the connection is consummated without disturbing the coating.

These and other objects and advantages are achieved in one aspect of the invention wherein a cathode ray tube having a viewing panel with a metallic fracture-protective member peripherally positioned thereround and an integrally related funnel portion having a skirt-like areal electrical conductive coating disposed thereon, utilizes an improved means for interconnecting the funnel coating with the spatially related protective member thereby effecting an external electrical connection by utilizing the conductivity of the member. The improvement includes an electrical conductive element that is formed of a continuous deposition of suitable conductive material having first and second opposed end sections, whereof the first end section makes positive electrical areal contact with the funnel coating which is laid thereover; the second end section of the continuous element making positive electrical connection with the metallic protective member. Substantially the whole of the conductive element is adhered to the exterior surface of the respective funnel and panel areas of the envelopic structure with which it is associated. Additionally, at least one connective element is formed and contiguously positioned to effect integral contact association with the protective member. It is through this electrical connective element, in conjunction with the conductive element and the conductive protective member, that the external operational electrical connection for the tube is consummated in an expeditious and simplified manner without disturbing the conductive element or the funnel coating with which it is associated.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

The term "fracture-protective member" which is positioned to peripherally surround the face panel portion of the tube envelope is generic terminology intended to include a number of specie embodiments of an electrical conductive metallic encompassing means, known in the art, that effect a predetermined compressive fracture-protective force against the periphery of the glass panel. Such protective means is intended to include a tension band per se, a tension band with a conjunctive rim band, and a rigid shell-like framing member peripherally affixed to the panel. Whichever species is employed, electrical connective means is associated therewith to facilitate the completion of an electrical connection with grounding circuitry in the chassis.

Figure 1:
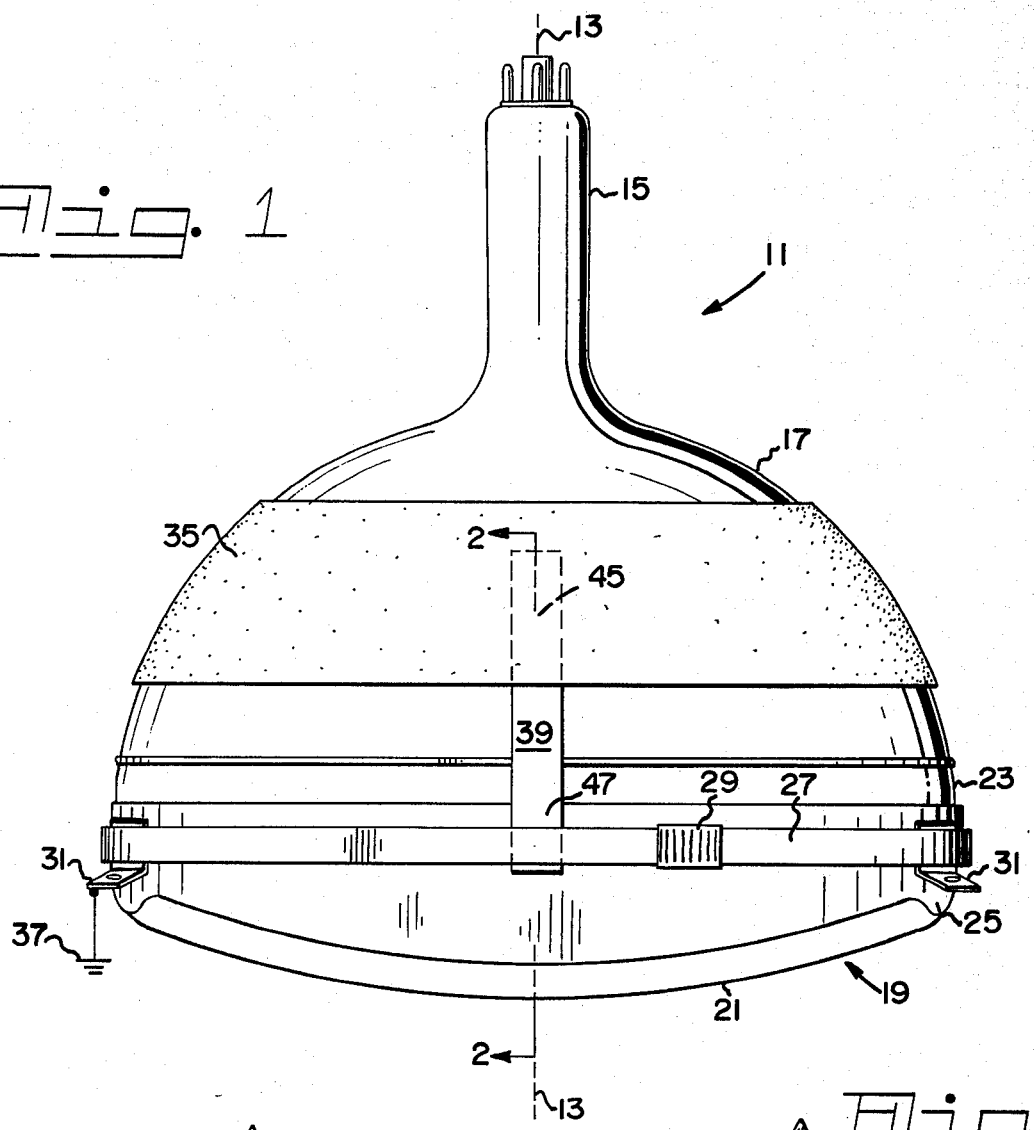
FIG. 1 is an exterior view of a cathode ray tube illustrating the connective improvement provided by the invention.

To orient the invention, reference is made to FIG. 1, wherein there is shown a cathode ray tube 11 having a longitudinal axis 13 therethrough. The glass envelopic structure includes an integration of neck, funnel, and panel portions; such structural components being common to both monochrome and color cathode ray tube enclosures. The neck portion 15 of the tube envelope, being a substantially cylindrical member, is joined to the small end of the substantially frusto-conical funnel member 17; the wide opening of the funnel being sealed to a compatibly shaped face panel 19. Although not shown, there is encompassed within the neck portion 15 an electron generating structure or gun assembly from which emanates one or more electron beams, these being directed and accelerated to impinge a cathodoluminescent screen disposed upon the interior surface of the face panel 19. The face panel per se is formed to have a viewing area 21 and a perimetrical flange portion 23.

Figure 2:
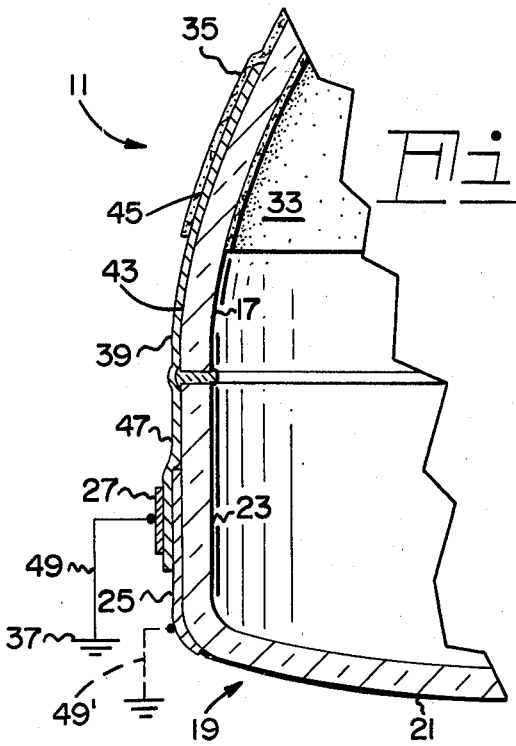
FIG. 2 is an enlarged partial sectional of the tube taken along the line 2—2 of FIG. 1 illustrating details of one embodiment of the invention. The internal components of the tube are not shown as they have no bearing on the invention.

With particular reference to FIGS. 1 and 2, there is shown an example of fracture-protective means peripherally associated with the flange portion of the face panel 19. The purpose of this protective measure is to inhibit fracture of the glass envelope and the explosive-implosive effects associated therewith. As shown, the exemplary structure includes a peripherally oriented rim band 25 contoured to substantially match the exterior shaping of the panel and form a frame for the viewing area thereof. This rim band is conventionally formed of metallic material, and is usually of two-piece construction such as a pair of symmetrically matching half sections, the ends of which overlap slightly to facilitate a snug peripheral fit around the flange of the panel.

Contiguously surrounding the rim band is a tension band 27 formed of high tensile strength metallic material such as steel strapping. During tube manufacturing this band is drawn to a predetermined desired tensioning around the flange, whereupon, the overlapping ends of the strapping are securely fastened by means such as, for example, a crimped retaining clip 29. As shown, tube mounting means 31, utilized for positioning the tube relative to the chassis of the display device, are for example, a plurality of substantially L-shaped rigid, strap-like members or "ears". These mounting members, which are usually contiguously associated with the tension band 27, are conventionally affixed by being pressurally sandwiched between the tension band and the associated rim band 25.

The funnel member 17 of the envelope has two electrical conductive coatings disposed thereon, one interiorly and the other exteriorly. The interior coating 33 is normally formed of a carbonaceous material, such as Aquadag, and is usually of the same electrical potential as that of the terminal electrode member of the electron generating means oriented within the neck portion 15 of the tube. The exterior coating 35 on the funnel member is a conductive material, such as Aquadag, and as previously described, forms a componential part, in conjunction with the interior coating and the intervening glass, to form a capacitive filtering effect for utilization in the operational circuitry.

Figure 3:
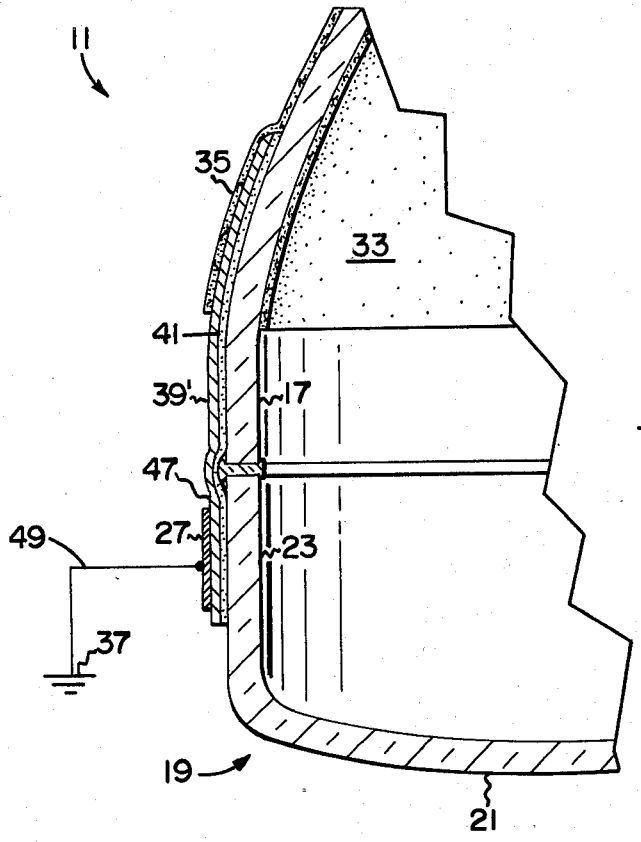

The invention pertains to an improved interconnective means for expeditiously connecting the exteriorly disposed funnel coating 35 to grounding means 37 in the chassis. As shown, an electrical conductive element 39, in the form of a continuous deposition of conductive material, is discretely adhered or interfacially bonded 43 to the exterior of the tube envelope. It is positioned on substantially the forward region of the tube envelope, usually in substantially axial orientation relationship to the tube axis 13. One embodiment of the conductive element is in the form of a thin, flexible strip-like medium or tape 39', which is affixed to the exterior of the envelope structure by suitable bonding means 41, such as shown in FIG. 3, for example. The exemplary materials include aluminum, copper, nickel, silver, silver alloys and other like functioning materials. Another embodiment of the conductive element is a deposition of particled metallic electrical conductive material continuously adhered to the surface of the envelope structure by a suitable vehicular binder or bonding agent, known to the electrical art. Such particled materials are also of the exemplary types mentioned above as comprising the strip-like medium.

The conductive element 39 has first and second opposed end sections, 45 and 47 respectively, whereof the first end section 45 is bonded to the funnel portion of the envelope, and the exterior funnel coating 35 is thence laid thereover to make positive contact therewith. The opposed or second end section 47 of the conductive element 39 is associated with the flange portion 23 of the face panel 19. As illustrated in FIGS. 1 and 2, the conductive element 39 is sandwiched between the rim band 25 and the tension band 27, making positive pressured contact with the tension band. Integrally associated with the tension band is at least one electrical connective element, such as the tube mounting means or ears 31, which in turn are connected to the grounding means 37 in the chassis.

In those instances when tube mounting means are not associated with the tension band, another embodiment of the connective element may be in the form of a flexible member extending from the tension band 27, or the conjunctive rim band 25, thereupon making proper contact with the grounding means 37, such being included as part of the grounding circuitry 49, or the phantomed circuitry 49', as shown in FIG. 2. Thus, a complete grounding circuit is established between the exterior funnel coating, the tension band, and the connective grounding element thereby effecting an external operational electrical connection for the tube without disturbing the conductive element 39 or the associated funnel coating 35.

In FIG. 3, there is shown an embodiment wherein the rim band has been omitted, the strip of conductive material 39' being bonded to the glass surface by suitable adhesive material 41 with the tension band 27 pressured thereagainst in overlay relationship.

Figure 4:
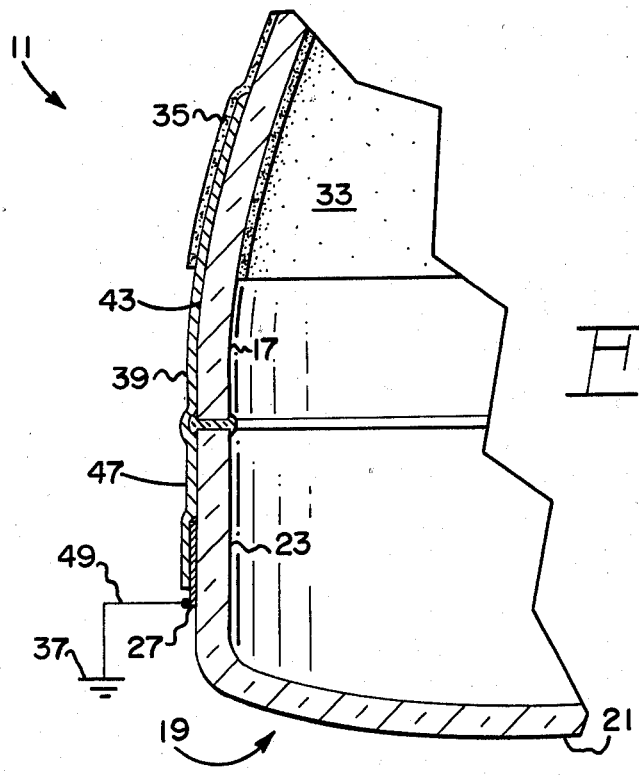

In the embodiment shown in FIG. 4, the tension band 27 is directly positioned on the panel flange, and the conductive element 39 applied thereover. This embodiment is preferred when the conductive material is disposed in particled form in liquid, semiliquid, or paste-like mediums, such being applied, for example, by brushing or masked-spray application.

Figure 5:
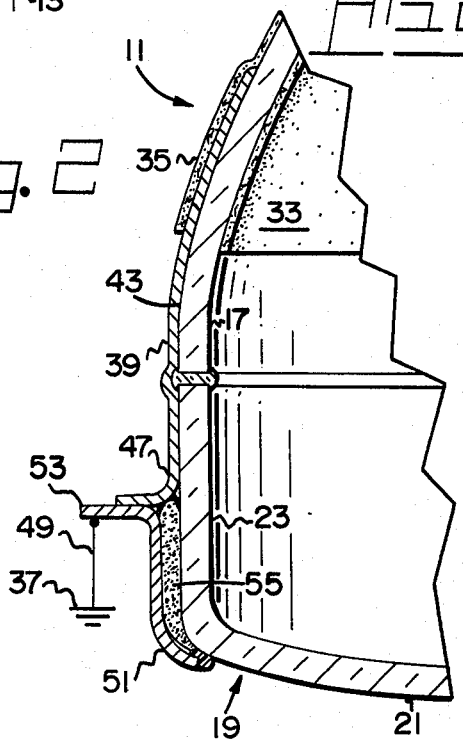
FIGS. 3, 4, and 5 are similar partial sectional enlargements of other embodiments of the invention taken along a 2—2 orientation as generally noted in FIG. 1.

The embodiment illustrated in FIG. 5 shows the utilization of a rigid one-piece metallic shell-like framing member 51 which is formed to have a shaping substantially matching the perimetrical contour of the face panel 19. This framing member incorporates an outstanding flange 53 which usually has a plurality of holes discretely positioned therearound to facilitate mounting of the tube 11 relative to the chassis. This shell-like frame is usually adhered to the panel by a setting-resin 55. The terminal portion of the second end section 47 of the electrical conductive element 39 is adhered to the framing member to effect connection therewith. The framing member is, in turn, connected to grounding circuitry 49.

In all embodiments the first end section 45 of the conductive element 39 is affixed to the funnel portion of the tube before the exterior funnel coating 35 is applied thereover. Thus, various embodiments are provided for effecting a multielement connective circuit that expeditiously consummates an efficient, yet simplified, connection between the funnel disposed coating on the exterior of the cathode ray tube and the grounding circuit in the chassis of a display device.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a cathode ray tube whereof the glass envelopic structure includes a viewing panel having a sidewall portion with a tensioned metallic band-like fracture-protective member peripherally positioned therearound and an integrally related funnel portion having a skirt-like areal carbonaceous electrical conductive coating exteriorly disposed thereon in a manner spatially separated from said band-like protective member, said improvement being electrical connective means for inter-connecting said separated conductive coating and fracture-protective areas on the exterior of said tube, said interconnective means comprising:

an electrical conductive element formed as a strip-like medium of a continuous deposition of a metallic conductive material differing in composition from that of said funnel coating and said band-like member, said conductive element being extensively adhered to the glass surface of said envelopic structure, said conductive element having first and second opposed end sections whereof said first end section is interfacially bonded to the glass surface of said funnel portion with said funnel coating subsequently laid thereover to make positive electrical connection therewith, and whereof said second end section makes positive electrical connection with said tensioned metallic protective members; said second end section of said conductive element being interfacially bonded to that portion of said panel sidewall adjacent said tensioned protective member, the terminal portion of said second end section being oriented in overlay relationship relative to said fracture-protective member; and at least one electrical connective element affixed to said protective member to facilitate the consummation of an external operational electrical connection for said tube without disturbing said conductive element or the funnel coating associated therewith.

2. The connective improvement disposed on the exterior of a cathode ray tube according to Claim 1 wherein said electrical conductive element is a deposition of at least one metallic material selected from the group consisting essentially of aluminum, copper, nickel, silver, and like functioning alloys thereof.

* * * * *